United States Patent [19]

Gordon

[11] 4,098,757

[45] Jul. 4, 1978

[54] POLYOLEFIN FIBERS CONTAINING BASIC PIGMENTS AND PROCESS FOR PREPARING SAME

[75] Inventor: Wolfgang Gordon, Hofheim, Taunus, Fed. Rep. of Germany

[73] Assignee: Hoechst Aktiengesellschaft, Frankfurt am Main, Fed. Rep. of Germany

[21] Appl. No.: 661,495

[22] Filed: Feb. 25, 1976

[30] Foreign Application Priority Data

Feb. 27, 1975 [DE] Fed. Rep. of Germany ..... 2508455

[51] Int. Cl.[2] ..... C08J 3/20

[52] U.S. Cl. ..... 260/42.55; 260/42.45; 260/42.57; 264/13; 264/211

[58] Field of Search ..... 264/13, 211; 260/42.19, 260/42.37, 42.57, 42.44, 42.54, 42.55

[56] References Cited

U.S. PATENT DOCUMENTS

| | | | |
|---|---|---|---|
| 3,554,683 | 1/1971 | Fujisaki et al. | 260/42.19 |
| 3,770,856 | 11/1973 | Ueki et al. | 264/13 |
| 3,803,065 | 4/1974 | Arai et al. | 260/23 H |
| 3,808,091 | 4/1974 | Aoki et al. | 264/13 |
| 3,914,354 | 10/1975 | Ueki et al. | 264/13 |
| 4,001,035 | 1/1977 | Ito et al. | 260/42.44 |
| 4,013,617 | 3/1977 | Gordon et al. | 260/42.55 |

*Primary Examiner*—Jay H. Woo

*Attorney, Agent, or Firm*—Curtis, Morris & Safford

[57] ABSTRACT

Hydrophilic polyolefin fibers containing more than 50 weight % of basic pigment, are obtained if a mixture of polyolefin, a solvent for this polyolefin, a basic pigment, a hydrophilization agent, water and an organic acid flows from a pressure vessel through a nozzle into a low-pressure chamber. The thus obtained fibers may be used for preparing synthetic paper without requiring much expenditure for work-up.

12 Claims, 1 Drawing Figure

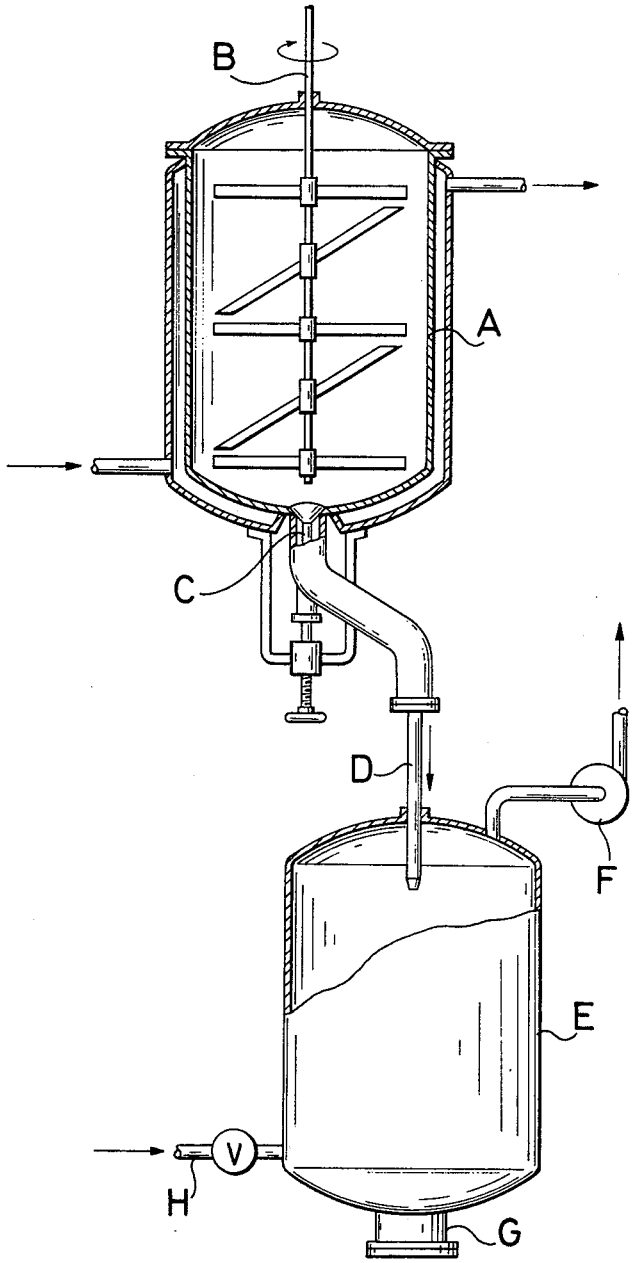
B
A
C
D
F
E
V
H
G

POLYOLEFIN FIBERS CONTAINING BASIC PIGMENTS AND PROCESS FOR PREPARING SAME

It is known for some time to produce polyolefin fibers containing pigments by adding "small amounts" of pigments and other insoluble compounds to a superheated polymer solution kept under pressure and to form fibers therefrom by flash evaporation. When applying this process to polyolefins, hydrophobic fibers are obtained of strictly non-hydrophilic properties, which greatly restrict their technical applications. Moreover, no specific disclosures are given about possibilities of producing fibers with higher pigment contents. It may be assumed that "small amounts" mean at any rate less than 20% by weight, calculated on the total weight of the fibers (cf. German "Auslegeschrift" No. 1 292 301).

A similar process is described, moreover, which provides for adding up to 50 weight % — calculated on the fiber weight — of insoluble fillers. This latter process also produces hydrophobic fibers. However, said patent specification does not go into the details of the particular difficulties encountered upon preparation of hydrophilic polyolefin fibers containing at the same time a high portion of filler (cf. German "Offenlegungsschrift" No. 2 252 759).

There is also known a process for preparing polymer fibers by flash evaporation of an emulsion of a polymer solution and an aqueous solution of a wetting agent, which also provides for adding pigments, though no reference is made there to the particular difficulties of this operation and of keeping it under control (cf. German "Auslegeschrift" No. 2 121 512).

On the other hand, it has not been made known yet how polyolefin fibers containing hydrophilic and basic pigments may be obtained. No mention is made there neither of hydrophilic polyolefin fibers containing more than 20 weight % nor of polyolefin fibers containing even more than 50 weight % of a basic pigment.

A further process has been suggested for preparing hydrophilic polyolefin fibers containing pigments which provides for hydrophobizing the pigment prior to its application. However, the hydrophobization is a complicated and expensive processing step (cf. German "Offenlegungsschrift" No. 2 424 291).

A process has now been found for preparing polyolefin fibers containing basic pigment, which comprises the flash evaporation of a superheated suspension kept at least under autogeneous pressure and consisting of (a) a basic pigment, (b) an emulsion of a solution of a polyolefin in a readily boiling solvent for these polymers and of an aqueous solution of a hydrophilization agent, (c) an organic acid, the flash evaporation being carried out through a nozzle in a low pressure zone.

Subject of the present invention is thus a process for preparing hydrophilic polyolefin fibers containing basic pigment, by means of a flash evaporation of a superheated suspension kept at least under autogeneous pressure, consisting of (a) basic pigment and (b) an emulsion of a solution of a polyolefin in a readily boiling solvent for these polymers and of an aqueous solution of a hydrophilization agent through a nozzle into a low pressure zone, which comprises that the suspension contains furthermore an organic acid, and the hydrophilic polyolefin fibers prepared according to this process.

A suitable polyolefin is a polyethylene with a reduced specific viscosity of 0.3 to 20 dl/g, preferably of 0.7 to 10 dl/g (determined according to H. Wesslau, Kunststoffe 49 (1959) 230) and a density of from 0.93 to 0.97 g/cm$^3$. This polyethylene may contain minor amounts of comonomers having from 3 to 6 carbon atoms, the density of the copolymer has to range within the limit of 0.93 to 0.97 g/cm$^3$, preferably from 0.94 to 0.965 g/cm$^3$. Further suitable polyolefins are homopolymers and copolymers of propylene, preferably containing an atactic portion of from 0 to 25 weight %, the best results being obtained with an atactic portion of from 0 to 6 weight %. Preference as copolymers of propylene is given to random copolymers having from 0.1–3 weight % of ethylene or from 0.1–2 weight % of butylene, but block copolymers with ethylene as well as random copolymers with higher comonomer portions are also suitable.

Suitable hydrophilization agents are, in principle, all known types of emulsifier, though preference is given to polymer hydrophilization agents with amine groups, amide groups, carboxyl groups and/or hydroxyl groups. Excellent results are especially obtained by polyvinyl alcohol having a viscosity of from 4 to 70 cp in a 4% solution in water at 20° C and a degree of saponification of from 80 to 99.5%. The hydrophylization agent shall confer a good dispersibility in water upon the polyolefin fibers filled with basic pigment, so that same shall acquire good wetting properties and become readily and uniformly dispersible in water.

The solvent used for the polyolefin shall have a sufficiently low boiling point, so that satisfactory superheating and flash evaporation are possible and its critical temperature shall be sufficiently high. Therefore, in the process of the invention, there are suitable hydrocarbons those having from 5 to 7 carbon atoms, preferably cyclic or acyclic saturated hydrocarbons having from 5–6 carbon atoms. Very good results can also be obtained with chlorinated hydrocarbons having one or two carbon atoms, preferably with methylene chloride.

The temperature of the suspension may vary within a range of from 110° to 200° C, preferably from 120° to 160° C. The suspension is kept under the autogeneous pressure of the water-solvent-mixture which may be increased by an inert gas and/or by pumping.

The suspension of a basic pigment and an emulsion formed of a solution of polyolefin and a solution of the hydrophilization agent shall be as uniform as possible. This requirement can be met by discontinuous or continuous operation as well, provided that this suspension be prepared in commercial suspension and emulsion devices with good substance circulation and satisfactory shearing effect. The advantages of the process according to the invention appear as well with water-in-oil emulsions and with oil-in-water emulsions.

For flash evaporation the suspension passes through a nozzle, the most important assignment of which is to maintain a pressure difference between suspension and flash chamber. The pressure in the flash chamber is adjusted so as to evaporate more than 90% of the solvent used for the polymer. This evaporation also includes part of the water, of course. The pressure shall generally range from 10 to 1500 mm Hg, preferably from 50 to 800 mm Hg. The pigment-containing fibers are essentially obtained moist with water and can be comminuted and dehydrated in commercial devices.

Suitable basic pigments are inorganic compounds, the aqueous suspension of which has a pH ranging from 8 to 12, such as oxides, hydroxides, carbonates and basic sulfates of metals of the second or third main group of the Periodic Table, or double salts of metals of the first, second or third main group of the Periodic Table and, optionally, of another metal. Suitable pigments are, for example, magnesium oxide, calcium hydroxide, aluminum hydroxide, hydrated or non-hydrated aluminum oxide, barium hydroxide, calcium carbonate, barium carbonate, basic aluminum sulfate and dolomite. The crystal structure or the degree of hydration of the pigment employed are of no importance in that respect.

The particle size of the basic pigments employed may vary widely. The pigments are most often used ground to a particle diameter smaller than 50 μm for 90% of the particles, preferably smaller than 10 μm. Mixtures of two or several basic pigments can be employed as well.

The quantity of the basic pigment to be used may vary widely. The advantages of the process become especially evident at 30 weight % or more of pigment, preference is given to the use of basic pigment at the rate of 50 weight % to 90 weight %. A pigment portion of 90 weight % is usually the maximum, for the fibers become very short beyond this limit.

The chemical structure of the organic acid which is used for the process according to the invention may vary within a wide range. Carboxylic acids are suitable as well as sulfonic acids. Appropriate organic radicals of this acid are aliphatic, aromatic or alkylaromatic radicals which may be non-cyclic, monocyclic or bicyclic. The number of said acid groups and their position to each other are of minor importance for the process of the invention. Preference is given to terminal monocarboxylic acids and monosulfonic acids having one organic radical which contains from 3–30 carbon atoms, preferably from 8–20 carbon atoms. Accordingly, there are preferably used dicarboxylic acids having from 6–20 carbon atoms and polymer compounds containing carboxyl groups having an acid number of from 50 to 500 mg of KOH/g. The organic acids employed may also contain different functional groups and heteroatoms, additionally to carboxyl groups or sulfonic acid groups, however, the advantages of the process according to the invention decrease more and more with increasing polarity of these functional groups and hetero atoms. Mixtures of various acids may be used as well, e.g. mixtures of fatty acids of different chain lengths and different numbers of double bonds, such as same occur with technical processes.

Preferably used organic acids are, for example, benzoic acid, benzosulfonic acid, naphthalene-carboxylic acid-(1), naphthalene-dicarboxylic acid-(1,2), naphthalene sulfonic acid-(1), naphthalene sulfonic acid-(2), adipic acid, lauric acid, palmitic acid, oleic acid, wax oxidates having an acid number of 50–500 mg of KOH/g and acid wax having an acid number of 50–500 mg of KOH/g.

The quantity of organic acid employed depends somewhat on its chemical structure. As a rule, there are applied from 0.1 to 10 weight% of organic acid, calculated on basic pigment, preference is given to the range from 0.5 to 5 weight %.

The concentration of organic acid in the suspension varies from 0.02 to 20 g/l, depending on what content in basic pigment in the fiber is aimed at and depending on the kind and quantity of hydrophilization agent. The residence time of organic acid in the emulsion is most often by 10 seconds or more, preferably by longer than 2 minutes. Extremely long residence periods do not alter the effect of the acid.

The acid-containing pigment suspension of a basic pigment and an emulsion formed of a solution of a polyolefin in an aqueous solution of a hydrophilization agent may be prepared according to known processes. The organic acid can be added to the suspension continuously or discontinuously e.g. in its pure liquid state or dissolved in the solvent for the polymer. The acid-containing suspension may be prepared as well in a different order. One possibility is e.g. to add the organic acid to the polyolefin solution, to suspend the pigment in this mixed solution and to emulsify this suspension with the aqueous solution of the hydrophilization agent; or a solution of polyolefin in organic acid may be mixed e.g. with an aqueous suspension of basic pigment and an aqueous solution of the hydrophilization agent, while emulsifying.

A discontinuous operation method calls for charging into a cold pressure vessel preferably polyolefin, basic pigment and organic acid in its pure state and hydrophilization agent pure or dissolved, as well as water and a solvent for the polymer in any order of succession and to prepare the suspension by heating together all components and stirring thoroughly.

A continuous operation method provides for preparing preferably a suspension consisting of the essential quantity of pigment in a solution of organic acid, in the solvent for the polymer, for diluting with this suspension a concentrated polyolefin solution — or for diluting a concentrated polyolefin suspension which is then heated for dissolution of the polyolefin. The thus obtained suspension of basic pigment in a solution of polyolefin and organic acid is then blended to form an emulsion with an aqueous solution of the hydrophilization agent and with an aqueous suspension of a comparably small amount of pigment in water which is recycled after comminution of the fibers and mechanical partial dehydration.

All embodiments dispense with an isolation of hydrophobized basic pigment requiring an expensive drying step. It is the surprising result of the experiments and a special advantage of this process that this isolation is not necessary.

The use of hydrophilic basic pigments brings about considerable technological complications unless organic acids are added. Experiments showed that only part of the hydrophilic basic pigment is incorporated into the fibers and thus sealed off in a polyolefin skin. About 40 – 70% of the hydrophilic pigment occur in the original powdery form and are washed off with the water upon the mechanical partial dehydration of the fibers. Therefore, quite expensive and complicated separating and recycling devices for important quantities of pigment are required so as to avoid losses. Another part of the pigment adheres only loosely to the fibers.

When comminuting the fibers, an operation which may be carried out in commercial fiber comminution devices, the adhering pigments are detached from the fibers and get lost again, unless they are recycled to a large extent. Moreover, the dispersion of basic pigment in the fibers is quite irregular, so that a relatively large number of short fibers is particularly rich in pigment. When being used for the manufacture of paper sheets, said short fibers pass through the sieve and pollute the waste water and thus create waste water disposal problems for the paper manufacturing industry, unless this portion is recovered.

It is surprising that the above mentioned problems do practically not arise upon application of the process according to the invention. The hydrophilic basic pigment is incorporated uniformly and almost completely into the polyolefin fiber. Therefore, the losses during flash evaporation, fiber comminution or paper manufacturing are small. These advantages emerge more and more with an increasing concentration rate of basic pigment in the fiber. In case that more than 35 weight % of hydrophilic basic pigment shall be incorporated into the fibers, the difference between the process of the invention and a processing method without organic acid has grown to such an extent that the expenditure would become prohibitive. In fact, the process according to the invention enables for the first time the preparation of fibers of polyolefin having more than 50 weight % of pigment, calculated on the fiber weight.

The process according to the invention has the further advantage that upon flash evaporation the fibers are obtained in a very uniform and short form at pigment contents of 50 weight % and more (calculated on the total weight of pigment and polyolefin), so that in most of the cases a further comminution of the fibers or homogenization of the fiber length can be dispensed with. None of the known means can achieve this effect without any pigment, even though very low polymer concentration rates may be applied.

Hydrophilic polyolefin fibers containing from 50–90 weight % of basic pigment may be employed as fibrous fillers in all fiber non-wovens. In comparison to non-fibrous fillers, they have the advantage of a better retention upon preparation of these non-wovens. So as compared with hydrophilic polyolefin fibers without basic pigment, their advantage resides in their better covering capacity in a non-woven. For example, calendered paper containing the fibers according to the invention is more opaque than calendered paper containing known polyolefin fibers. The hydrophilic character of the pigment-containing fibers is necessary for enabling the processing of the fibers from an aqueous suspension — e.g. in paper industry.

The following examples and drawing illustrate the advantages of the process and the fibers according to the invention:

EXAMPLE 1

Into an autoclave A (See the FIG.) having a volume of 70 l and being equipped with a five-blade-multistage-impulse-countercurrent stirrer B, are charged 0.6 kg of polyethylene (density 0.960 g/cm$^3$, reduced specific viscosity 1.4 dl/g, molecular weight distribution $M_w/M_n=6$), 20 l of hexane, 15 l of water, a solution of 40 g of polyvinyl alcohol (viscosity of a 4% solution in water at 20° C: 4 cp, degree of saponification: 98%) in 400 ml of water, 2.4 kg of calcium carbonate with 90% of the particles having a size smaller than 8 μm, as well as 72 g of industrial stearic acid at 140° C being dissolved together at 600 rpm of the stirrer, emulsified and suspended. The all-over pressure in the vessel is adjusted to 16 kg/cm$^2$. After having opened the dump valve C, the emulsion flows through a tubular nozzle D having an interior diameter of 4 mm and a length of 1.20 m into a recipient E, wherein a vacuum pump F maintains a pressure of about 100 mm Hg and where the produced fibers are collected. Residual hexane which remained in the fibers is evacuated by conducting steam over the fibers from the steam line H, under vacuum. The aqueous fibers are removed from the vessel E through the orifice G which can be sealed.

The product fibers contain — after partial dehydration by mechanical compression to about 30% of fiber content — 76.7% of the employed calcium carbonate, i.e. the retention upon the flash evaporation step amounts to 96.0%. The obtained fibers have a hydrophilic character and are easily dispersible in water. If 2 g of these fibers are dispersed uniformly in a 1 liter measuring cylinder in 800 ml of water by shaking repeatedly, and if this fiber suspension is allowed to stand for exactly 2 minutes, the fibers sink slightly so that the supernatant water free from fibers takes a volume of 30 ml.

If the thus obtained fibers are subjected to a diaphragm classifier according to Brecht-Holl for 10 min./sieve under a water pressure of 0.5 atmosphere gauge and maximum lift, a quantity of 2 g is retained by 32% on a sieve having a mesh width of 0.40 mm, 59% were retained on a sieve with a mesh width of 0.12 mm, whilst 9% passed through this latter sieve. This result showed that the fibers were uniform and short, so that they may be used e.g. in the paper manufacturing industry without any additional comminution.

When a paper sheet weighing 160 g/m$^2$ was formed on a Rapid-Köthen Sheet-Former from the fibers obtained by Example 1, this sheet contained 73% of pigment, i.e. 95% of the pigment was retained during the fiber processing step. For all processing steps, comprising fiber-forming and fiber-processing, the retention of pigment amounted to 91.4%. On the other hand, when trying to prepare a pigment-containing sheet of 75% of hydrophilic pigment and of 25% of comparable polyethylene fibers which do not contain any pigment, the pigment was retained at a rate of only 21%.

COMPARATIVE EXAMPLE A

The process is the same as described in Example 1, with the exception that no stearic acid is added.

The produced fibers contain 43% of calcium carbonate after partial dehydration by mechanical compression to a fiber content of about 30%.

When these fibers are classified according to Example 1, 89% are retained on a sieve having a mesh width of 0.40 mm, 9% on a sieve having a mesh width of 0.12 mm and 2% of the fibers pass through this latter sieve. Though these fibers are well hydrophilic, they are not freely dispersible as a diluted suspension, but still cling together.

The fibers reach a length comparable to that of example 1 only after two comminutions in a 12 inch disk refiner of Messrs. Sprout-Waldron in known manner. The classification then results in 25% being retained on a 0.40 mm sieve, 62% retained on a 0.12 mm sieve and 13% passing through the 0.12 mm sieve. After a partial mechanical dehydration as described the content in calcium carbonate was only 36%, representing a pigment retention of 45% in the preparation of fibers.

If a sheet weighing 160 g/m$^2$ is formed on a Rapid-Köthen Sheet-Former from the thus comminuted fibers, this sheet contains only 32% of calcium carbonate, i.e. the pigment retention from the fiber preparation to the fiber processing amounts to only 40%. It appears to be impossible to obtain by this manner hydrophilic fibers containing more than 50% of pigment. The pigment quantities which are not retained have to be recovered and fed back into the circuit by complicated and costly means.

EXAMPLE 2 with COMPARATIVE EXAMPLE B

In the same way as described in Example 1 there are emulsified and suspended 1.2 kg of polyethylene (reduced specific viscosity 3.4 dl/g, $M_w/M_n=6$, density 0.945 g/cm$^3$ by statistical copolymerization of ethylene with butene), 20 l of cyclohexane, 10 l of water, a solution of 50 g of polyvinyl alcohol in 0.5 l of water and 0.8 kg of dolomite (particle size $d_{50} = 2$ μm) and 16 g of naphthalene-sulfonic acid-(2). Fibers are prepared by flash-evaporation, which are then comminuted in a disk refiner in three comminution operations.

The parallel test is run without the use of naphthalene-sulfonic acid-(2), and the prepared primary fibers are comminuted under identical conditions in 5 comminution steps. Table 1 shows the obtained fiber length distribution as being carried out according to Example 1, as well as the pigment contents after flash evaporation, after comminution and after formation of a sheet according to Example 1.

TABLE 1

| Pigment | without naphthalene sulfonic acid-(2) | with napthalene sulfonic acid-(2) |
|---|---|---|
| Dolomite - applied [1)] | 40 | 40 |
| % Dolomite[1)] after flash evaporation | 21 | 38 |
| % Dolomite[1)] after comminution | 17 | 36.5 |
| % Dolomite[1)] in the sheet | 13 | 34 |
| Fibers | | |
| % retained on 0.40 mm sieve | 17 | 22 |
| % retained on 0.12 mm sieve | 61 | 56 |
| % passed thorough 0.12 mm sieve | 22 | 22 |

[1)]% of pigment calculated on the weight of dolomite and polyethylene

EXAMPLE 3 with COMPARATIVE EXAMPLE C 1.0 kg of polypropylene (reduced specific viscosity: 2.3 dl/g, 3.3% of heptane-soluble portions (12 hours in a soxhlet apparatus), 20 l of isopentane, 20 l of water, a solution of 60 g of polyvinyl alcohol (viscosity of the solution of 4 g/l in water at 20° C: 66 cp, degree of saponification: 99%) in 600 ml of water, 1.0 kg of aluminum oxide trihydrate (particle size $d_{50} = 0.8$ μm) and 25 g of acid wax (acid number 145 mg of KOH/g, saponification number: 165 mg of KOH/g, dropping point:81° C) which had been obtained from montan wax by chromic acid oxidation, was emulsified and suspended. By subsequent flash evaporation under the conditions of Example 1, except for the pressure being here 25 kg/cm$^2$ above the suspension and a pressure of 250 mm Hg in the flash chamber — there are prepared polypropylene fibers, then comminuted in one stage in a disk refiner. The comparative test is carried out without acid wax, whereby the fibers formed during the flash evaporation are comminuted in two stages. Table 2 shows the contents in pigment and the classification analysis.

TABLE 2

| Pigment | without acid wax | with acid wax |
|---|---|---|
| % Pigment applied | 50 | 50 |
| % Pigment after flash evaporation | 21 | 43 |
| % Pigment after comminution | 17 | 40.5 |
| % Pigment after sheet formation | 15 | 38 |
| Fibers | | |
| % retained on 0.40 mm sieve | 17 | 19 |
| % retained on 0.12 mm sieve | 64 | 55 |
| % passed through 0.12 mm sieve | 19 | 26 |

(% of pigment calculated on the total weight of pigment and polypropylene).

What is claimed is:

1. A process for making hydrophilic clay-containing polyolefin fibers which comprises preparing a suspension consisting essentially of
   (a) from 30 to 90% by weight of a non-pre-hydrophobized basic pigment, said pigment in aqueous suspension having a pH value of from 8 to 12,
   (b) an emulsion of a solution of a polyolefin in a readily boiling solvent for said polyolefin, said solvent being a hydrocarbon having from 5 to 7 carbon atoms or a chlorinated hydrocarbon having from 1 to 2 carbon atoms and an aqueous solution of a hydrophilizing agent containing a group or groups selected from amine-, amide-, carboxyl- and hydroxyl groups and
   (c) from 0.1 to 10% by weight, based on the weight of said basic pigment, of an organic acid of 3 to 30 carbon atoms having a terminal mono-carboxylic or mono-sulfonic acid group, superheating said suspension under at least an autogenous pressure and flowing said suspension through a restricted passage to a relatively low pressure zone to cause flash evaporation of said solvent and to form said hydrophilic pigment-containing polyolefin fibers.

2. The process according to claim 1, which comprises that polyethylene having a density of 0.93 – 0.97 g/cm$^2$ is used as polyolefin.

3. The process according to claim 1, which comprises that polypropylene having an atactic portion of from 0 – 25% is used as polyolefin.

4. The process according to anyone of claims 1, which comprises that polyvinyl alcohol is used as hydrophilization agent.

5. The process according to anyone of claims 1, which comprises that a saturated hydrocarbon having 5 or 6 carbon atoms or methylene chloride are used as solvent for the polyolefin.

6. The process according to anyone of claims 1, which comprises that the suspension, prior to flash evaporation, has a temperature of from 110° to 200° C.

7. The process according to anyone of claims 1, which comprises that the flash evaporation zone has a pressure of from 10 to 1500 mm Hg.

8. The process according to anyone of claims 1, which comprises that 90 weight % of the particles of the basic pigment are smaller than 50 μm.

9. The process according to anyone of claims 1, which comprises that magnesium oxide, calcium hydroxide, aluminum hydroxide, aluminum oxide, barium hydroxide, calcium carbonate, barium carbonate, basic aluminum sulfate or dolomite are used as basic pigment.

10. The process according to anyone of claims 1, which comprises that aliphatic, aromatic or alkyl-aromatic carboxylic acids or sulfonic acids having from 8 – 20 carbon atoms or polymer compounds containing carboxyl groups, having an acid number of from 50 – 500 mg of KOH/g are used as organic acid.

11. The process according to anyone of claims 1, which comprises that from 0.1 – 10 weight %, preferably from 0.5–5 weight % of organic acid is used per part by weight of basic pigment.

12. Hydrophilic polyolefin fibers containing a basic pigment being an inorganic compound the aqueous suspension of which has a pH of from 8 to 12, at the rate of from 50 – 90 weight % said fibers being prepared by the process according to claims 1.

* * * * *